United States Patent [19]

Christini et al.

[11] 3,940,512

[45] Feb. 24, 1976

[54] METHOD AND APPARATUS FOR CONCOMITANT PARTICULATE DEPOSITION IN ELECTROLESS PLATING, AND THE PRODUCT THEREOF

[75] Inventors: Theodore P. Christini, Dushore, Pa.; William P. Flynn, Georgetown, Md.; John B. Inskeep; Harry J. McCauley, both of Wilmington, Del.

[73] Assignee: E. I. Du Pont de Nemours and Company, Wilmington, Del.

[22] Filed: May 13, 1974

[21] Appl. No.: 469,499

Related U.S. Application Data

[62] Division of Ser. No. 103,355, Jan. 25, 1971, Pat. No. 3,853,094.

[52] U.S. Cl. ..... 427/180; 427/201; 427/210; 427/214; 427/217; 427/242; 427/304; 427/437; 51/309 R; 118/418

[51] Int. Cl.[2] ..... B32B 15/04; C23C 3/02

[58] Field of Search..... 117/130 E, 100 B, 100 M, 117/100 S, 100 C; 51/309, 308, 295; 427/180, 304, 347, 242, 201, 214

[56] References Cited

UNITED STATES PATENTS

| | | | |
|---|---|---|---|
| 2,858,256 | 10/1958 | Fahnoe et al. | 51/309 |
| 2,941,501 | 6/1960 | Bell | 118/418 |
| 3,753,667 | 8/1973 | Metzger et al. | 29/195 |

*Primary Examiner*—John D. Welsh

[57] ABSTRACT

A method for concomitant particulate deposition in electroless plating wherein objects to be plated are subjected to tumbling during the plating process.

1 Claim, 7 Drawing Figures

METHOD AND APPARATUS FOR CONCOMITANT PARTICULATE DEPOSITION IN ELECTROLESS PLATING, AND THE PRODUCT THEREOF

This is a division of application Ser. No. 103,355, filed Jan. 25, 1971 now U.S. Pat. No. 3,853,094.

BRIEF SUMMARY OF THE INVENTION

Generally, this invention comprises method and apparatus for concomitant particulate deposition in electroless plating comprising contacting articles to be plated with a continuously circulating electroless plating solution containing suspended particulate material which it is desired to deposit on said articles, and subjecting the articles to tumbling within the plating solution for a sufficient time to obtain a preselected amount of electroless plating with concomitant deposition of particulate material on the articles, and the product thereof.

DRAWINGS

Figure 1:
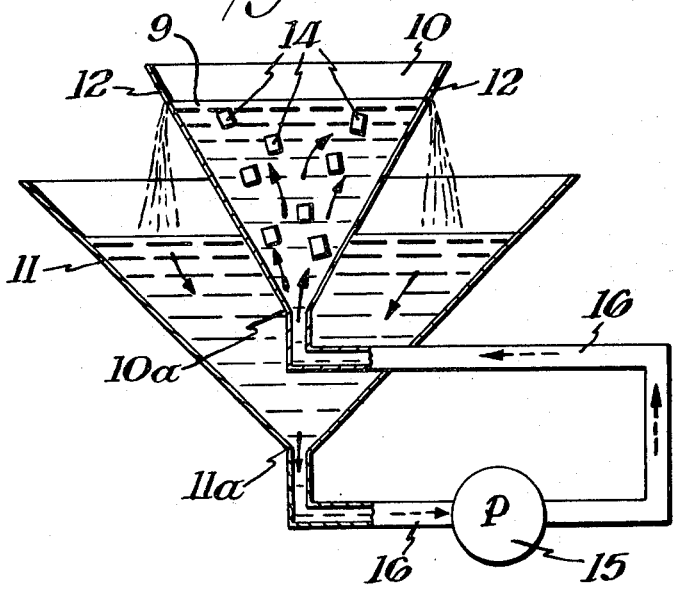
Figure 2:
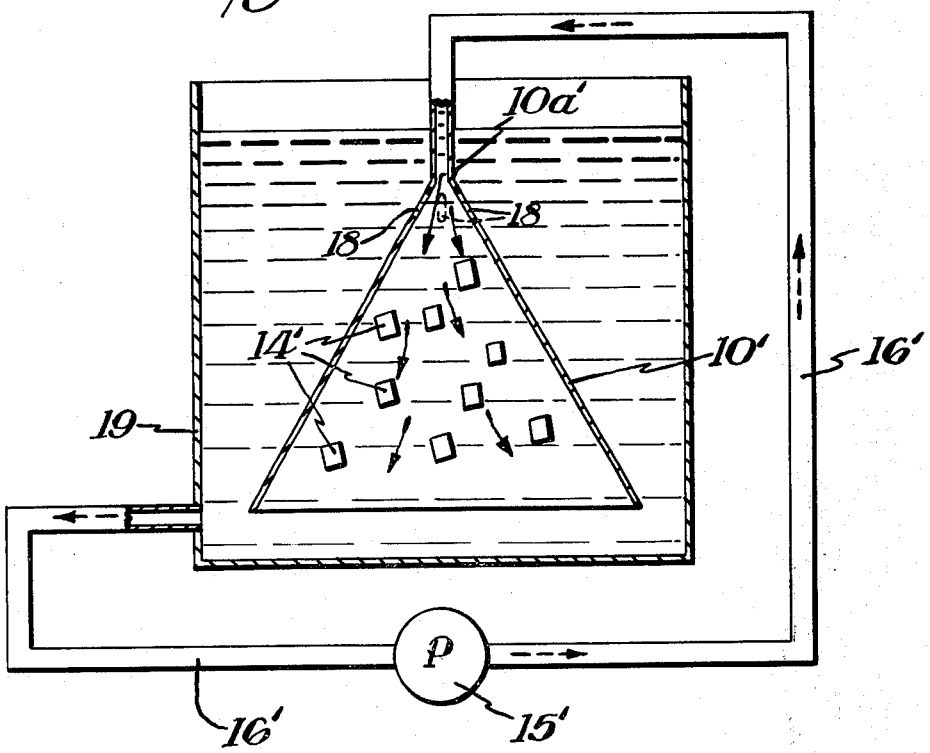
Figure 3A:
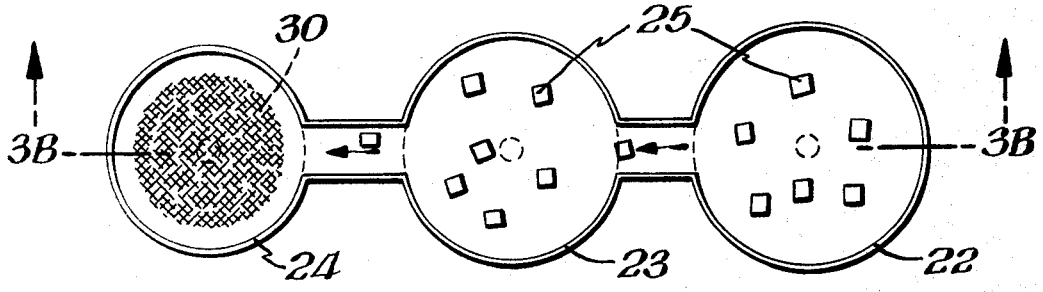
Figure 3B:
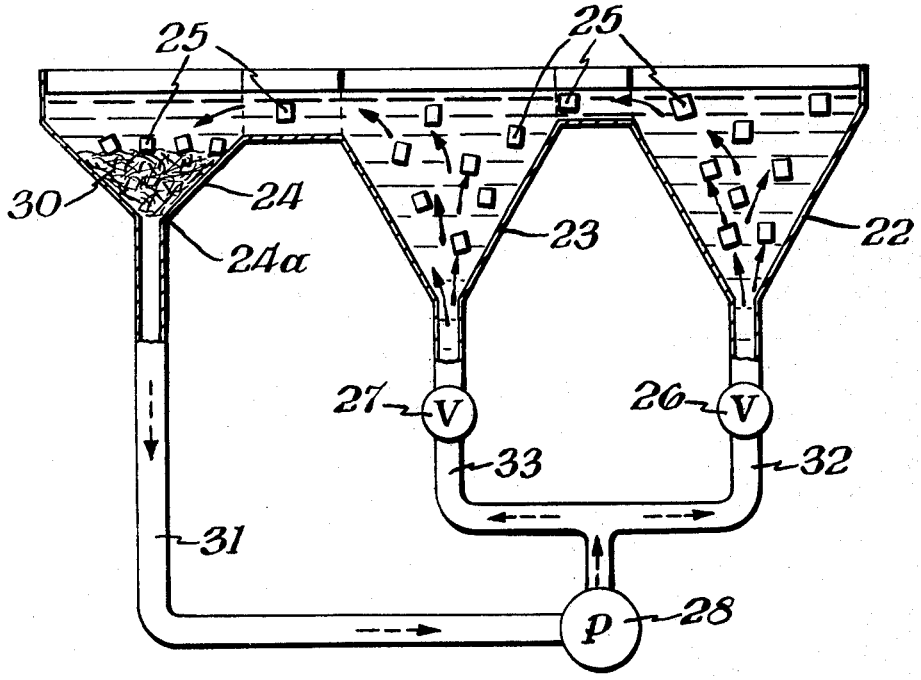
Figure 4:
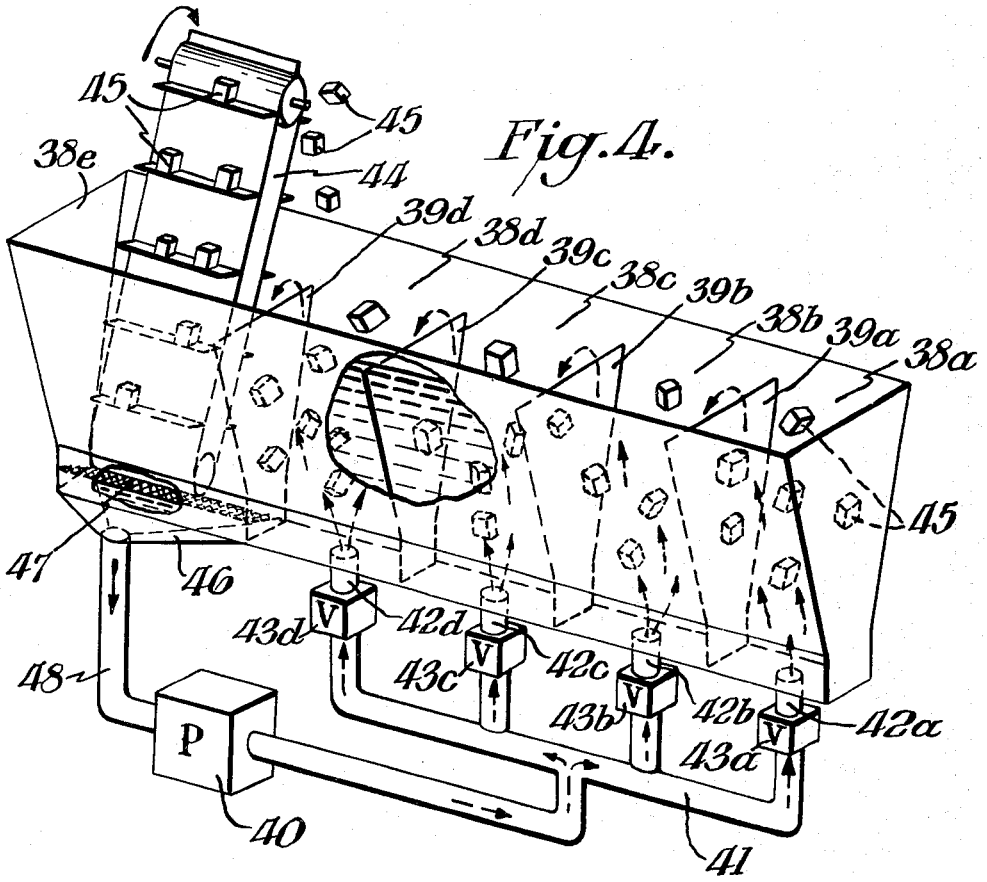
Figure 5A:
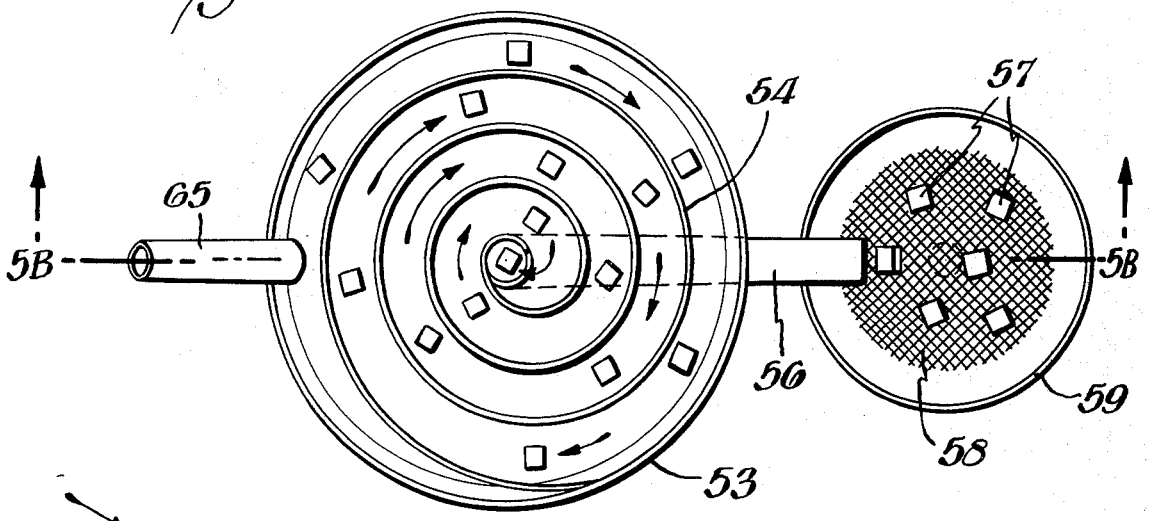
Figure 5B:
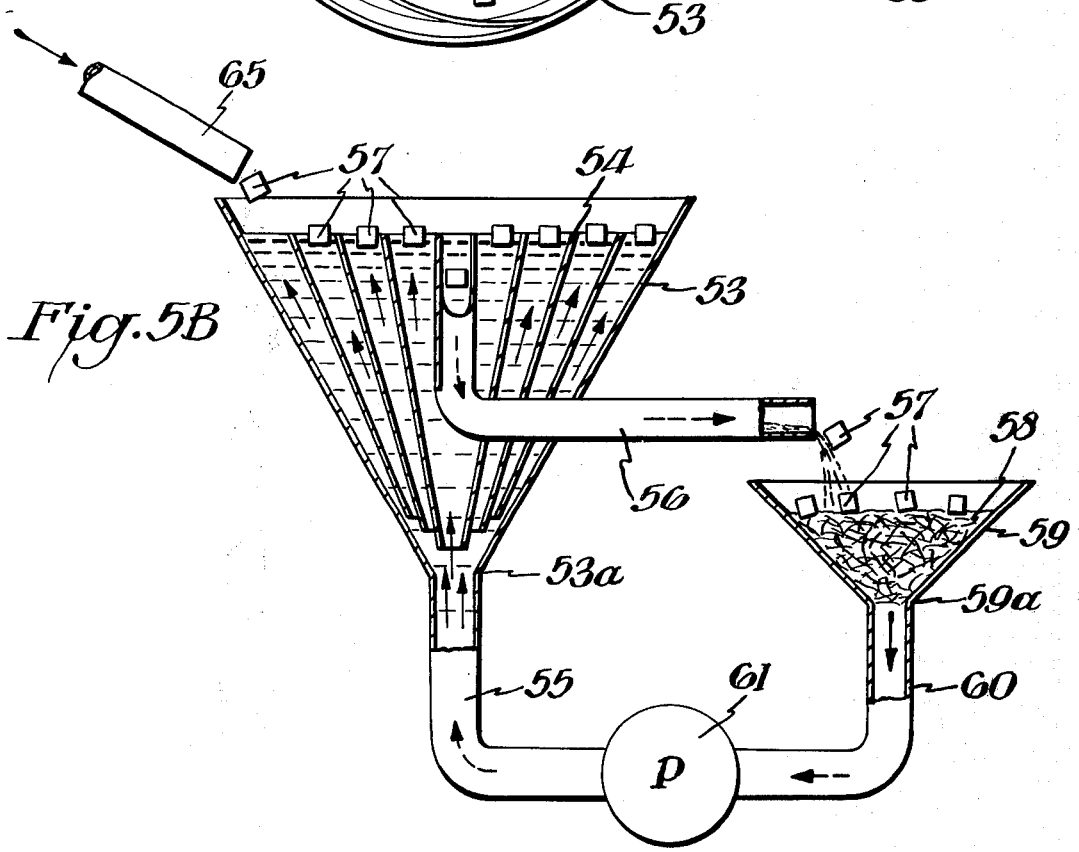

The following schematic drawings depict preferred embodiments of apparatus for carrying out the invention, in which:

FIG. 1 is a cross-sectional side elevation view of an apparatus wherein the plating solution is supplied in generally upward vertical flow, FIG. 2 is a cross-sectional side elevation view of an apparatus for plating buoyant articles wherein the plating solution is supplied in generally downward vertical flow, FIGS. 3A and 3B are, respectively, plan and side elevation cross-sectional views of a first design of apparatus for conducting plating in sequential stages, FIG. 4 is a partially cross-sectional perspective view of a second design of apparatus for conducting plating in sequential stages, and FIGS. 5A and 5B are, respectively, plan and side elevation cross-sectional views of an apparatus incorporating a continuous spiral baffle for effecting continuous, as distinguished from batch, plating.

PRESENT PRACTICE

Electroless metal plating of both electrically conductive and electrically non-conductive articles is known to the prior art; however, there exist serious problems as regards plating bath stability.

Thus, in a typical situation, described in U.S. Pat. No. 3,234,031, involving nickel plating as an example, the soluble nickel salt, in this instance dissolved $NiCl_2 \cdot 6H_2O$, is reduced by an alkali metal borohydride ($NaBH_4$) in order to plate out nickel on an object immersed in the bath. The Patent reported prior art difficulties with more or less sudden bath decomposition, during which Ni metal flakes either formed, or a heavy black precipitate dropped out when the concentration of the plating metal in the baths had decreased from 10 to 25% in the course of plating. The Patent solution to this problem was to add an organic divalent sulfur compound as stabilizer.

Also, U.S. Pat. No. 2,847,327 reported similar bath instability, which was reportedly cured by adding critical amounts of long chain aliphatic organic compounds.

Finally, U.S. Pat. No. 3,261,711 offered the solution of bubbling oxygen continuously through the bath to maintain the oxygen content at the saturated level.

None of these Patents was concerned with the concomitant deposition of suspended particulate material during the plating, and they are mentioned here only because they point up a serious problem of plating bath instability, even in the absence of suspended particulate substances.

THE INVENTION

This invention constitutes a method and apparatus for surface coating either electrically conductive or non-conductive articles, which can typically be metallic, polymeric, ceramic or even wooden objects, by electroless plating deposition of metal which concomitantly carries with it a particulate substance suspended in the plating bath, together with the product obtained. The coatings obtained comprises a metallic-alloy matrix within which is uniformly distributed the particulate substance as dispersed phase.

As an example, there is hereinafter described (Example 4) the deposition of a wear-resisting coating on a polymeric base, specifically a twisting jet utilized in the manufacture of synthetic textile yarns, wherein the objects coated have slots as narrow as 10 mils wide and bores as small as 10 mils diameter, so that the problems of smooth uniform coating are formidable indeed, due to requirements of fine dimensional control maintainance. However, the invention is not, of course, limited to these items and is broadly applicable wherever a continuous metal coating incorporating distributed particulate material is the objective. Thus, catalyst preparation, super-conductor manufacture and many other utilizations are practicable.

Conventional electroplating processes have been hitherto utilized to effect simultaneous electrodeposition of metals and hard particles as additives, in order to provide enhanced wear resistance. However, these have not been entirely satisfactory, especially when the items to be coated have recesses or hollow interiors, because the throwing power is inadequate to give uniform coverage. This is particularly the case for yarn guides and yarn-treating jets, which require high uniformity in coating composition in all regions contacted by a moving yarn line.

Moreover, high coating adherence is an absolute requirement, and the coatings of this invention are extremely adherent, so that there is no requirement for additional bonding steps, such as pressure sintering, or the like.

The feasibility of fine-particle incorporations in electroless baths during plating has been doubted until now, because of the strong tendency towards spontaneous bath decomposition whenever suspensoids of any kind exist which can serve as nuclei for the random decomposition of the bath and the heavy drop out of black precipitate, hereinbefore reported in the prior art. Such precipitation brings further plating to an immediate halt or, alternatively, produces rough, unsightly deposits which are completely unacceptable.

Applicants have found, suprisingly, that by continuously circulating their plating baths in the course of plating and, at the same time tumbling their articles to be plated within the bath, they not only obtain complete bath stability but, equally as important, obtain greatly improved plate coatings within which the particulate additive distribution is extremely uniform.

Bath compositions suitable for use in this invention can cover a wide range; however, those operating at lower temperatures, e.g., in the range from about 30° to 60°C. are particularly preferred. The best available baths from the standpoint of inherent stability are, of course, preferred, and those of U.S. Pat. No. 3,234,031 utilizing amine boranes as reductants have worked well.

Typical metallic-alloy matrices deposited can consist of the Ni-P alloy coatings deposited by the processes taught in U.S. Pat. Nos. 2,532,283; 2,658,841; 2,658,842, and others. Or one can equally well utilize the Ni-B alloy coatings of U.S. Pat. Nos. 3,096,182; 3,062,666; 3,338,729; and 3,234,031.

Electroless plating, which is sometimes referred to as chemical reduction plating, occurs by catalytic reaction between metal ions or compounds and a reducing agent dissolved in an appropriate solvent. Thus, the electroless Ni-P coating processes hereinabove mentioned typically proceed when aqueous solutions containing the reductant $H_2PO_2^-$ ions exist within a bath containing nickel ions supplied by dissolved nickel salts. Similarly, the electroless Ni-B coating processes typically proceed when aqueous solutions containing a boron reducing agent, such as $BH_4^-$ ions or dimethylamin borane, are present in the nickel ion bath. All practical electroless plating baths also contain buffers, e.g., salts of weak carboxylic or dibasic acids, to prevent rapid changes of pH, plus at least one of a large variety of chemical additives which have been found to stabilize against spontaneous bath decomposition.

Electroless plating is an autocatalytic process in the sense that the coating deposited serves as a catalyst for continuation of the plating action. Once plating has been initiated on the surface of a metallic, ceramic, or polymeric substrate, it continues as long as the substrate remains in contact with the plating solution. Because a uniform coating of any desired thickness can be applied by direct chemical reaction, without the passage of an electric current, the process was denoted "electroless plating" by Brenner and Riddell, who developed the first practical Ni-P processes (refer to J. Research, National Bureau of Standards, Vol. 37, p. 31 (1946), Brenner, A. and Riddell, G.E.).

The phase dispersed in the metallic alloy coatings of this invention can consist of a broad variety of particulate materials. Where wear resistance is the desideratum, hard inorganic particles such as oxides, carbides, nitrides, silicides, borides, diamond, metallic or various intermetallic compounds are suitable.

The particles are preferably approximately equiaxial in shape, with an average size ranging from about 0.1$\mu$ to about 20$\mu$, and a lenth-to-width ratio ranging from about 2:1 to about 20:1. Typical powders are described in the following:

TABLE I

| Chemical Formula | Crystal Structure | Morphology Shape & Average Size, $\mu$ | Comments |
|---|---|---|---|
| $\alpha Al_2O_3$ (Linda A) | hexagonal | equiaxed 0.3$\mu$ | levigated, uniform size |
| $\alpha Al_2O_3$ (Alundum) | hexagonal | acicular l = 20$\mu$ w = 10$\mu$ | −600 mesh |
| $\gamma Al_2O_3$ | cubic | equiaxed 0.1$\mu$ | levigated, uniform size |
| $TiO_2$ | tetragonal | acicular l = 3$\mu$ w = 0.2$\mu$ | |

Broadly, the process of this invention is concerned with the handling of particle additives in the range of about 0.05 $\mu$–100$\mu$ particle size while controlling the bath agitation to maintain these particles in suspension for a time sufficient to effect composite plating of an immersed substrate, during which time bath conditions are maintained to achieve optimum stability and service life.

Particle settling rate is a function of particle size as well as the viscosity of the plating bath. Settling is also affected by particle concentrations, or loading, and degree of bath agitation. Plating rate, on the other hand, is influenced by many factors, which include among others (a) pH of the plating solution, (b) concentration of the reductant, (c) temperature of plating bath, (d) concentration of metal ions, and (e) ratio of bath volume to plating area.

Some plating of the metal onto the fine particles while they are in suspension can occur, depending upon the nature of the particles and whether they have been made catalytically active. Ordinarily, no preparatory treatment of the fine particles is necessary. The surface of the object to be plated will, in general, have been prepared to receive an adherent coating of metal and occluded particles by a suitable cleaning and chemical pretreatment prior to the electroless plating procedure. In all cases, for nonconductive substrates, the article to be plated will have been given a preliminary metal "strike" to help secure the particles. The additions of particles to be occluded in the metal matrix can be kept in suspension for the required time periods by agitating the bath solution, which also causes the particles to be moved into contact with the surface to be plated.

The nature of bath agitation can have an important effect on the coatings obtained, predominant orientations of the particles sometiems resulting as a function of bath motion. In prior art apparatus, it has been observed that there can be preferential particle settling on horizontal surfaces, depending, in part, on particle size.

With this invnetion, it is practicable to preselect the concentration of additive particles in the composite coating to suit the article end use. Thus, coatings containing as little as 3% by volume of additive particles have been produced, whereas heavier contents sometimes up to 15% by volume and greater were equally attainable.

The bath agitation resorted to in our process utilizes continuous circulation of the plating bath through a contacting zone of pregressively expanding cross-section in order to obtain a tumbling suspension of the articles to be plated at all times during which they are in the plating zone.

Previously, it has been the practice to use plating racks for the suspension within the bath of articles to be plated. However, these racks are objectionable, in that there occurs wasteful plate deposition thereon, which often requires "stripping" after each plating cycle. In addition, racks have not provided adequate support for parts having small-diameter, deep holes within which uniform penetration and distribution of the plating bath solution is required. Also, racks prevent complete encapsulation of articles to be plated, since there must be some point of attachment to, or bearing support provided by, the racks. Thus, the elimination of racks altogether, as has been done in our invention, is advantageous for numerous reasons.

In addition, the mode of agitation of this invention has increased the tolerance of electroless plating baths for particulate solids, so that very high levels, e.g., up to 15 g./1., have been utilized without inducing bath decomposition. This is an unexpected benefit, especially in electroless plating, which permits lay-down of very concentrated particulate inclusions. Moreover, effective particulate suspensions have been maintained over very long time periods, bath lives in excess of 60 hours being routinely obtained using our process.

In tumble plating with the apparatus hereinafter described, small plastic, ceramic or metal parts are conveniently handled in groups ranging from 1 to 100 in number.

The polymers employed were two varieties of commercially available plating grade acrylonitrile-butadiene-styrene, specifically, Borg Warner Co. EP3510 and the glass-fortified AF-1004 of Liquid Nitrogen Processing Corporation.

The pretreatment was in the following sequence with a given group of articles placed in a stainless steel wire basket for convenient step-by-step handling:

1. Cleaning consisted of immersion in a proprietary alkaline cleaner (Marbon C-15) for 5 mins. at 65°C., in order to remove any grease or oil picked up in molding or handling operations.
2. The articles were then rinsed in hot and cold water for periods of 30 secs. each.
3. To promote coating adhesion to the article surfaces, the articles were chemically roughened by immersion in a proprietary chromic-sulfuric acid etch (e.g., Marbon E-20), immersion being for 4–6 mins. at 65°C. with mild agitation.
4. To remove any etch solution carry-over from step (3) the articles were rinsed in hot and cold water for 3 secs. each, followed by an ultrasonic water rinse of 2 mins. and a final rinse with running de-ionized water.
5. The articles were then sensitized by immersion in a proprietary (Enthone-432) bath which contains tin ions, the treatment being for 1½ mins. at room temperature, with the parts agitated in the bath.
6. Two de-ionized water rinses of 30 secs. duration under gentle agitation were next used to remove excess tin ions from the articles.
7. The articles were then placed in a proprietary activation bath (Enthone −440) containing Pd ions. The tin ions are thus further oxidized, under gentle agitation for 1.5 mins., thereupon reducing the Pd ions to metallic state.
8. The articles were then given two separate de-ionized water rinses of 30 secs. duration each, under gentle agitation.
9. Finally, the articles were placed in a Ni-B strike bath for 8–10 mins., the composition of this bath being identical with that of the particulate substance tumble plating bath hereinafter described, except free of particles for this pretreatment.

For ceramic parts, the preplate treatment is the same as hereinbefore described, except that a different treatment would be substituted for steps (2)–(4), inclusive, to achieve roughening of the ceramic surface. Thus, mechanical roughening might be substituted for chemical roughening.

For metal parts, yet another preplate treatment is required. Thus, a low C steel is prepared for plating by solvent degreasing (e.g., acetone or trichloroethylene), alkaline cleaner and then a rinse in 50 vol. % HCl solution with rinses in de-ionized water after each step. The parts could then be placed directly in the tumble plating bath.

Referring now to FIG. 1, a preferred design of tumble plater according to this invention utilizes a large frustoconical funnel 10 coaxially disposed within, and somewhat above, a larger funnel 11 constituting a sump for reception of the gravity exhaust of plating solution 9 from funnel 10. Peripherally spaced small size ports 12 in funnel 10 permit free overflow of solution (and suspended particulate solids) from this funnel without escape of the articles 14 being plated.

The plating solution is continuously recycled from the apex 11*a* of the lower funnel via pump 15 and recirculating line 16, which latter discharges into the apex 10*a* of funnel 10. A typical plating bath composition can be as taught in U.S. Pat. No. 3,234,031 supra, with bath temperature maintained at about 55°C.

Periodic analyses of the bath ingredients are made, with replenishments as required.

Pretreated articles to be plated are dumped into funnel 10 and initially tend to settle to the bottom under gravitational force. However, as they approach the bottom they encounter the upwardly directed jet stream of suspended particles recycled by pump 15 via line 16. A very complex article tumbling action results from the turbulence of the jet flow, the gradual deceleration of upward solution travel with progressive cross-sectional increase of funnel 10 and random collisions between the articles being plated. Most of these collisions tend to rotate the articles, causing a random non-directional agitation of the parts. The degree of bath agitation depends on the velocity of plating solution supply and the number of articles charged into the plater, as well as the size and degree of loading of suspended particles.

The advantage of a funnel 11 sump over a cylindrical reception vessel, for example, is that suspended solids are afforded no surfaces upon which they can deposit, so that uniform suspension concentrations are preserved indefinitely. In addition, the range of loading factor in terms of ratio of weight of powder to volume of solution is considerably broadened.

Prior practice has hitherto favored the use of more or less quiescent baths, free of turbulence. However, we have found that tumble plating is positively advantageous, because it favors the formation of uniform surface topography free from burrs and massive nodules. Moreover, there is obtained a more uniform dispersion of occluded particles in the plate coat. Elimination of article-holding racks permits easy inspection of individual articles in process by simply scooping them out as desired.

An extremely important advantage of tumble plating is the increased throwing power thereby obtained. This results from the impingement of a high-velocity stream of plating solution, containing suspended particles, which impacts all surfaces of the substrate plated in random manner within the bath. This unique action distinguishes tumble plating from conventional prior art barrel plating methods used in electroplating composites, affording the following advantages:

1. A high volume percentage of paricles is incorporated into the plate coat at relatively low bath loading factors of weight of powder/liter plating solution.
2. Incorporation of particles over the entire surface, and into small diameter holes and narrow slots occurs.

3. Greater breadth is achieved as regards the size and shape of particles which can be incorporated in composite coatings.

For example, our tests have shown that a composite electroless Ni-B coating with 13.1% of $\alpha Al_2O_3$ can be deposited from a plating bath containing 15 g./l. of Linde A alumina powder. Electrodeposition of a nickel composite coating with a comparable volume percent requires a bath loading factor of the order of 50 to 150 g./1.

Articles having a wide range of densities and geometries can be plated by the method of this invention. Thus, for buoyant articles 14', the apparatus of FIG. 2 can be employed, which utilizes an inverted frustoconical funnel 10' provided with ports 18 at its upper, constricted end through which the articles can be conveniently introduced. With this design a cylindrical sump 19 is provided in open communication at its lower end with funnel 10', recirculation of plating solution being obtained by pump 15' having its intake connected via line 16'to the bottom of sump 19 and its discharge to the upwardly disposed apex 10*a'* of funnel 10'.

It is, of course, practicable to separate the sump from the plating chamber, as by intermediate pipe connection, which can be desirable where the bath temperatures to be maintained in each are different.

Apparatus can be constructed from a wide variety of materials, such as Pyrex brand glassware, stainless steel, or stainless steel coated with a suitable corrosion-resistant polymer coating. Frequently, cleaning with nitric acid solution is desirable, and appropriate corrosion resistance must then be provided.

A specific apparatus constructed generally according to FIG. 1 utilized a frustoconical plating chamber 10 of 7 inches top diameter, the interior angle of the chamber being 48°. A 2 inch high cylindrical rim was adhered to the top of the funnel and this was provided with twelve ¼ inch dia. liquid overflow holes spaced equally around the periphery.

The diameter of feed and outlet tubes was ⅜ inch i.d. and the pump 15 utilized was a Cole-Parmer 1/35 H.P. sealless magnetic drive centrifugal pump with polypropylene body and impeller. The elbow connecting with orifice 10*a* was ¾ inch vertical dimension.

Except where otherwise indicated, the plating bath composition employed in the following examples was a standard DMAB (i.e., dimethylamine borane) reductant bath, as follows:

| | |
|---|---|
| Nickel acetate | 50.0 g./l. |
| Sodium citrate.$2H_2O$ | 25.0 g./l. |
| Lactic acid | 25.0 g./l. |
| DMAB (i.e., dimethylamine borane) as reductant | 2.5 g./l. |
| TDGA (i.e., thiodiglycolic acid) as stabilizer | 0.1 g./l. |
| Santomerse S (commercial wetting agent) | 0.1 g./l. |

The bath was prepared from a number of stock solutions which are numbered as follows for convenient reference:

| | | |
|---|---|---|
| Solution I | Nickel Acetate | 62.5 g./l. |
| | Sodium Citrate | 31.3 g./l. |
| | Lactic Acid | 31.3 g./l. |
| Solution II | TDGA (i.e. thiodiglycolic acid) | 20.0 g./l. |
| Solution III | Santomerse S | 2.0 g./l. |

-continued

| | | |
|---|---|---|
| Solution IV | DMAB (i.e., dimethylamine borane) | 30.0 g./l. |

To prepare 1 liter of plating solution, the sequence and amount of stock solutions added was as follows:

1. Heat 800 ml of Solution I to 55°C.
2. Adjust pH (measured at room temperature) to 6.5 by addition of reagent-grade $NH_4OH$.
3. Add 5 ml of Solution II.
4. Add 50 ml of Solution III.
5. Add 83 ml of Solution IV.
6. Add distilled water to bring bath volume to 1 liter.

Once prepared, the DMAB bath was operated under the following conditions:

1. pH at room temperature — 6.3 to 6.5
2. Temperature — 55°C.
3. Area plating factor — 5 to 10 sq.in./1.
4. Bath replenishment was made at intervals of 1 hr.

The bath-replenishment schedule was based on prior experimental work wherein wet chemical analyis of the DMAB and nickel ion concentrations were made during plating runs. The plating bath concentrations for each run were brought to standard levels during the "heat-up" period by making a wet chemical analysis and then adding the appropriate amounts of nickel ions, DMAB or TDGA.

For each run, the number of polymeric articles plated in the tumble plater (design of FIG. 1) were the same. The acrylonitrile-butadiene-styrene EP3510 articles consisted of five rectangles of dimensions ⅛ × ⅜ × ¾ inch, with a hole ⅛ inch diameter, ⅛ inch long, and a hole 1/16 inch diameter, ⅛ inch long, together with five rectangles of dimensions ⅛ × ⅜ × ¾ inch with a hole 1/32 inch diameter, ⅛ inch long, and a hole 1/64 inch diameter, ⅛ inch long. Finally, there were five glass-filled polymer articles (acrylonitrile-butadiene-styrene AF-1004) with approximate dimensions of ¾ × ⅜ × ⅜ inch having a hold 3/64 inch diameter, ¼ inch long, intersecting at right angles with a hole 0.028 inch diameter, ⅛ inch long. The articles were first taken through the standard polymer preplate line hereinbefore described.

Wherever a "tumble plater" is referred to in this description, it will be understood that article tumbling was conducted, regardless of whether the plating solution contained suspended solids or not.

The tumbling in the reported Examples was gentle in nature, involving 5 or 6 end-over-end rotations per minute of single articles, as observed with a stop watch. However, the tumbling rate can, of course, be varied broadly to suit particle requirements.

EXAMPLE 1

One lot of specimens as described was taken from the polymer preplate line and placed for 10 mins. in a 4-liter beaker which contained a standard DMAB plating bath, with gentle agitation being provided to the parts by manually imparting an up-and-down motion to the stainless steel basket in which they were contained. The specimens, plated with a thin nickel strike, were then transferred by dumping from the basket into the plating chamber of the tumble plater (FIG. 1), which also contained the standard DMAB plating bath. Plating ensued for 1 hr. in this bath, free of any hard-particle additions. Then a quantity of $\alpha Al_2O_3$ of hexagonal crystal structure and an aquiaxed shape with average particle size of 0.3$\mu$ was introduced into the tumble plater from a blended suspension of these particles in a separate beaker containing the DMAB plating bath. Over a period of 3½ hr., 90 g. of $\alpha Al_2O_3$ was added to the bath at hour intervals in 30 g. increments. Since the final tumble-plater bath volume was 6 liters, the $\alpha Al_2O_3$ loading factor at the end of the run was 15 g./1.

Metallographic and X-ray examination confirmed the presence of a composite $\alpha Al_2O_3$-electroless Ni-B deposit on the polymer substrates. Also, metallographic examination confirmed the presence of a composite coating in all hole diameters. Quantimet analysis (i.e., the Quantimet Image Analyzing Computer marketed by Metals Research, Ltd., Hertz, England) indicated that 13.1 vol. % of $\alpha Al_2O_3$ was present in the composite layer. Yarn-line wear testing by running in contact with a coated specimen a 15-denier dull nylon monofilament with conditions of 5° break angle 10 g. load, and 1000 yd./min. travel velocity indicated that the wear after 10 mins. was $0.113 \times 10^{-6}$ cm$^3$ or $0.678 \times 10^{-6}$ cm$^3$/hr.

EXAMPLE 2

A second lot of specimens was taken from the polymer preplate line and placed for 10 mins. in a 4-liter beaker which contained the standard DMAB plating bath. Gentle agitation was provided to the parts by manually imparting an up-and-down motion to the stainless steel basket in which they were contained. The specimens were then emptied from the stainless steel basket into the tumble plater (FIG. 1 design) and allowed to plate for 1 hr. in this bath. The tumble plater bath was the same one as used in Example 1, except that it had been carefully filtered at the end of the preceding run in order to remove any suspended hard particles. At the end of the 1Hr. plating period, $\alpha Al_2O_3$ of hexagonal crystal structure and an acicular shape with average particle size of $20 \times 10\ \mu$ was introduced into the tumble plater. Over a period of 4½ hrs., 12 g. of $\alpha Al_2O_3$ was added to the bath at half-hour to hour intervals in 1.2 g. or 2.4 g. increments.

Metallographic and X-ray examinations confirmed the presence of a composite $\alpha Al_2O_3$ — electroless Ni-B deposit. Also, metallographic examination confirmed the presence of a composite coating in all hole diameters. Quantimet analysis indicated that 10.1 vol % of $\alpha Al_2O_3$ was present in the composite layer. Yarn-line wear testing for a period of 6 hrs. using 15-denier dull monofilament with conditions of 5° break angle, 10 g. load, and 1000 yd./min. running velocity indicated that the wear was $0.0163 \times 10^{-3}$/hr. Since the tumble plater bath volume was 6 liters, the $\alpha Al_2O_3$ loading factor at the end of the run was 2 g./1.

EXAMPLE 3

A third lot of specimens was taken from the polymer preplate line and then placed in a 4-liter beaker which contained the standard DMAB plating bath for 10 mins. Gentle agitation was provided to the parts by manually imparting an up-and-down motion to the stainless steel basket in which they were contained. The specimens were then emptied from the stainless steel basket into the tumble plater (FIG. 1 design) and allowed to plate for 1 hr. in this bath. The tumble plater bath was the same one used in Example 2, except that it had been carefully filtered at the end of the preceding run in order to remove any suspended hard particles. At the end of the 1-hr. plating period, acicular rutile ($TiO_2$) of tetragonal crystal structure, and with a fiber diameter of 0.2 microns and a fiber length of 3 microns, was introduced into the tumble plater. The addition was 6 g., corresponding to a loading factor of 1 g./1. The composite plating period was 3½ hrs.

Metallographic and X-ray examination confirmed the presence of a composite acicular rutile — Ni-B deposit. Also, metallographic examination confirmed the presence of a composite coating in all hole diameters. Quantimet analysis indicated that 3.4 vol % of acicular rutile was present in the composite layer. Yarnline wear testing for a period of 1 hr. using 15-denier dull monofilament with conditions of 5° break angle, 10 g. load, and 1000 yd./min. running velocity indicated that the wear was $0.196 \times 10^{-6}$ cm$^3$/hr.

EXAMPLE 4

A small wear article fabricated from glass-filled AF-1004 polymer was formed with an injection molded flared entrance through slot measuring 7 mils wide × 40 mils long × 200 mils deep.

The article, after the hereinbefore described polymer pretreatment, was coated by the following procedure, using the apparatus of FIG. 1:

a. 1 hour of electroless tumble plating in the standard DMAB plating bath, free of particulate additions,
b. 3½ hours of electroless tumble plating in the standard DMAB plating bath containing 2 g./1. addition of suspended 9$\mu$ dia. diamond particles, and
c. 2 hours of electroless plating in a conventional magnetic-stirred beaker contained standard DMAB plating solution, free of particulate additions, this last step being added to provide metallographic edge protection.

A micrograph sectional plan view taken at the 100 mil level clearly showed an extraordinarily uniform coating over the slot walls of about 2 mil thickness, throughout which 9$\mu$ diamond particles were uniformly dispersed. This example illustrates the excellent "throwing power" capability of the invention method, particularly for plating the interiors of small holes and slots.

EXAMPLE 5

The following Table II reports a number of different plating runs made according to this invention in apparatus of FIG. 1 indicating composite dependence on particle size and also on particle nature (e.g., Ni-B baths were not effective to lay down titanium diboride or tungsten carbide on the polymer substrates involved and in the case of Ti metal a composite was not obtained in all areas).

All baths were of the Ni-B type, except the last reported, which was a commercial Ni-P type, marketed by the Shipley Co., Boston, Mass.

TABLE II

| Description of Article | | | | | |
|---|---|---|---|---|---|
| Substrate Material | Holes or Cavities | Particulate Material | Total g./l. | Particle Size and Shape | Remarks |
| | | $Al_2O_3$ | 2 | equiaxed | no composite observed |

TABLE II-continued

| Description of Article: Substrate Material | Holes or Cavities | Particulate Material | Total g./l. | Particle Size and Shape | Remarks |
|---|---|---|---|---|---|
| | | | | 0.3μ | |
| EP 3510 polymer (size and shape 3/4" × 3/8" × 1/8") | 1/8", 1/16" 1/32", and 1/64" diam. holes 1/8" deep | $Al_2O_3$ | 5 | equiaxed 0.3μ | composite coating all areas, 9.1 vol. % |
| | | $Al_2O_3$ | 15 | equiaxed 0.3μ | composite coating all areas, 13.1 vol. % |
| | | $Al_2O_3$ | 0.1 | acicular 20μ × 10μ | low loading of particles on surface; no composite in 1/64" hole |
| and | | $Al_2O_3$ | 2 | acicular 20μ × 10μ | composite coating all areas, 9.6 vol. % |
| AF-1004 glass-filled polymer (size and shape approximately 3/4" × 3/8" × 3/8") | 3/64" and 1/32" hole intersecting at 90°; open-ended cavity 200 mil × 40 mil × 7 mil | $TiO_2$ | 1 | acicular 0.2μ × 3μ | composite coating all areas, 3.4 vol. % |
| | | $TiO_2$ | 15 | acicular 0.2μ × 3μ | composite coating all areas |
| | | diamond | 2 | equiaxed 9μ | composite coating all areas |
| | | $MoSi_2$ | 2 | equiaxed 1–20 μ | composite coating all areas |
| | | BN | 2 | equiaxed 1–10 μ | composite coating all areas |
| EP 3510 polymer (size and shape 3/4" × 3/8" × 1/8") | 1/8", 1/16", 1/32", and 1/64" diam. holes 1/8" deep | Ti | 2 | equiaxed 1–5 μ | no composite observed |
| | | Ti | 10 | equiaxed 1–5 μ | composite observed in some areas |
| and | | SiC | 2 | equiaxed 1–10 μ | composite coating all areas |
| AF-1004 glass-filled polymer (size and shape approximately 3/4" × 3/8" × 3/8") | 3/64" and 1/32" hole intersecting at 90°; open-ended cavity 200 mil × 40 mil × 7 mil | $TiB_2$ | 2 | equiaxed 1–10 μ | no composite; plating on particles |
| | | WC | 2 | equiaxed 1–10 μ | no composite; plating on particles |
| | | $Al_2O_3$ | 2 | acicular 20 × 10 μ | composite coating on exterior surfaces; no composite in 1/64", hole |

Other designs of apparatus adapted to conduct plating in sequential stages, or continuously (as contrasted with batch-wise in FIGS. 1 and 2) are shown in FIGS. 3–5, inclusive.

Thus, FIGS. 3A and 3B illustrate a series arrangement comprising three funnel-type platers 22, 23 and 24, connected at their upper ends in order from right to left, so that articles 25 to be plated can be impelled in sequence from one plater to the next by appropriate manipulation of valves 26 and 27 after preselected residence times in each plater. In the interim, with valves 26 and 27 turned down, pump 28 is operated to recirculate plating solution continuously via lines 32 and 33, without transfer of the articles, but, of course, maintaining tumbling at all times.

Finally, articles 25 are caught on screen 30, mounted across the outlet 24*a* of plater 24, from which they can be removed at will while the plating solution is recycled via line 31 connected to the intake of pump 28.

A somewhat similar design is depicted in FIG. 4, the platers 38*a*–38*d* being, in this instance, trough-like in form and generally V-type in transverse cross-section.

Weirs 39*a* and 39*d*, preferably of slightly decreasing height in the order recited, define the individual plater stages. A single pump 40 discharges into a common manifold 41 which is provided with individual discharge jets 42*a* to 42*d*, inclusive, servicing individual platers. Transfer of articles from one plater to the next in sequence is readily effected by periodic manual manipulation of the individual valves 43*a*–43*d*, inclusive.

The terminal compartment, 38*e*, serves merely as a collector for articles 45 having finished plate coatings, automatic article removal being obtained by an inclined, cleated belt conveyor 44, which is intermittently operated by a motor (not shown) to carry the articles out to a suitable finished-product collector.

Compartment 38*e* is provided with an inclined funnel bottom 46, covered with a sloped screen 47, through which plating solution is immediately withdrawn via pump intake line 48, so that suspended particles have no opportunity to settle out during solution recycle.

A modification in this design entails cutting vertically oriented alternately arranged slots in weirs 39*a*–39*c* (with, optionally, a shallower slot in weir 39*d*), so that there is continuous flow of plating solution and articles being plated through the apparatus. This has the disadvantage that certain articles might dwell longer within given plating cells than others, with corresponding variation in plating coats. However, acceptance by visual inspection cures this difficulty.

FIGS. 5A and 5B show a single funnel continuous plater 53 provided with a spiral baffle 54 defining a continuous plating path from the outside periphery to the center.

Baffle 54 is open at the bottom, so that a single jet 55 connected to the funnel apex 53*a* provides tumbling action throughout the entire plating path. Discharge of plating bath solution (and articles 57) is effected via drain connection 46 communicating with the terminal center of baffle 54.

Articles 57 are caught on screen 58 covering the exit end of sump funnel 59, whereas plating solution is recycled from the outlet end 59*a* via pump intake line 60 through centrifugal pump 61 back into the plater via jet 55.

Articles to be plated are supplied to the outside periphery of the plater by gravity feed through an inclined pipe chute 65.

Numerous other specific designs of apparatus can be provided to suit special requirements, utilizing the general principles hereinbefore elaborated with reference to FIGS. 1–5, inclusive.

What is claimed is:

1. In the electroless plating of preconditioned articles of metal, ceramic, glass, polymer, wood or other material of small enough mass affording buoyant suspension within an electroless plating solution incorporating a soluble salt of a platable metal together with a soluble reductant for said metal, the obtainment of concomitant particle inclusion with the electroless plate of insoluble, inert non-catalytic particles in the size range of about $0.05\mu$ to about $100\mu$ comprising subjecting said articles to buoyant tumbling within a continously circulating expanding jet stream of said electroless plating solution containing a suspension of said particles for a sufficient time to obtain a preselected amount of electroless plating with concomitant deposition of said particles on said articles.

* * * * *

UNITED STATES PATENT AND TRADEMARK OFFICE

CERTIFICATE OF CORRECTION

PATENT NO. : 3,940,512

DATED : FEBRUARY 24, 1976

INVENTOR(S) : THEODORE P. CHRISTINI, WILLIAM P. FLYNN, JOHN B. INSKEEP and HARRY J. McCAULEY It is certified that error appears in the above-identified patent and that said Letters Patent are hereby corrected as shown below:

Col. 2, line 16, "comprises" should read --comprise--.
Col. 3, line 23, "thylamin" should read --thylamine--.
Col. 3, line 51, "lenth" should read --length--.
Col. 4, line 38, "sometiems" should read --sometimes--.
Col. 4, line 42, "invnetion" should read --invention--.
Col. 4, lines 46-47, delete "sometimes" and insert --of--.
Col. 4, line 51, "pregressively" should read --progressively--
Col. 6, line 63, "paricles" should read --particles--.
Col. 8, line 40, "hold" should read --hole--.
Col. 8, line 53, "particle" should read --particular--.
Col. 8, line 68, "aquiaxed" should read --equiaxed--.
Col. 9, line 36, "1Hr." should read --1-hr.--.
Col. 9, line 51, "$10^{-3}$" should read --$10^{-6}cm^3$--.
Col. 10, line 37, "contained" should read --containing--.

Col. 14, line 3, "with" should read --within--.

Signed and Sealed this

Sixth Day of July 1976

[SEAL]

*Attest:*

RUTH C. MASON
*Attesting Officer*

C. MARSHALL DANN
*Commissioner of Patents and Trademarks*